US008580349B1

(12) United States Patent
Kordosh et al.

(10) Patent No.: US 8,580,349 B1
(45) Date of Patent: Nov. 12, 2013

(54) PIGMENTED SPRAY TEXTURE MATERIAL COMPOSITIONS, SYSTEMS, AND METHODS

(75) Inventors: John Kordosh, Simi Valley, CA (US); Randal W. Hanson, Bellingham, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

(21) Appl. No.: 13/312,893

(22) Filed: Dec. 6, 2011

Related U.S. Application Data

(63) Continuation of application No. 12/080,638, filed on Apr. 3, 2008, now abandoned.

(60) Provisional application No. 60/922,119, filed on Apr. 5, 2007.

(51) Int. Cl.
*B05D 1/02* (2006.01)

(52) U.S. Cl.
USPC ..... 427/421.1; 239/337; 239/548

(58) Field of Classification Search
USPC ..... 427/421.1; 239/337, 548
See application file for complete search history.

(56) References Cited

U.S. PATENT DOCUMENTS

| | | | |
|---|---|---|---|
| 208,330 | A | 9/1878 | Palmer |
| 351,968 | A | 11/1886 | Derrick |
| D25,916 | S | 8/1896 | Woods |
| 568,876 | A | 10/1896 | Regan |
| 579,418 | A | 3/1897 | Bookwalter |
| 582,397 | A | 5/1897 | Shone |
| 658,586 | A | 9/1900 | Reiling |
| 930,095 | A | 8/1909 | Seagrave |
| 931,757 | A | 8/1909 | Harmer |
| 941,671 | A | 11/1909 | Campbell |
| 1,093,907 | A | 4/1914 | Birnbaum |
| 1,154,974 | A | 9/1915 | Custer |
| 1,486,156 | A | 3/1924 | Needham |
| 2,127,188 | A | 8/1938 | Schellin et al. |
| 2,149,930 | A | 3/1939 | Plastaras |
| D134,562 | S | 12/1942 | Murphy |
| 2,307,014 | A | 1/1943 | Becker et al. |
| 2,320,964 | A | 6/1943 | Yates |
| 2,353,318 | A | 7/1944 | Scheller |

(Continued)

FOREIGN PATENT DOCUMENTS

| | | |
|---|---|---|
| CA | 770467 | 10/1967 |
| CA | 976125 | 10/1975 |

(Continued)

OTHER PUBLICATIONS

Homax Products, Inc., "Easy Touch Spray Texture Brochure", Mar. 1992, 1 page.

(Continued)

*Primary Examiner* — Timothy Meeks
*Assistant Examiner* — Nathan T Leong
(74) *Attorney, Agent, or Firm* — Michael R. Schacht; Schacht Law Office, Inc.

(57) ABSTRACT

A coating material adapted to be applied to a target surface comprises a texture material base and pigment material. The texture material base comprises solvent/carrier material comprising water, resin/binder material comprising a latex binder, and filler material comprising a polymeric thickener. The texture material base and the pigment material are combined and deposited on the target surface to form a durable, irregular, colored surface.

6 Claims, 3 Drawing Sheets

(56) References Cited

U.S. PATENT DOCUMENTS

| | | | |
|---|---|---|---|
| 2,388,093 | A | 10/1945 | Smith |
| 2,530,808 | A | 11/1950 | Cerasi |
| 2,565,954 | A | 8/1951 | Dey |
| 2,686,652 | A | 8/1954 | Carlson et al. |
| 2,723,200 | A | 11/1955 | Pyenson |
| 2,763,406 | A | 9/1956 | Countryman |
| 2,764,454 | A | 9/1956 | Edelstein |
| 2,785,926 | A | 3/1957 | Lataste |
| 2,790,680 | A | 4/1957 | Rosholt |
| 2,831,618 | A | 4/1958 | Soffer et al. |
| 2,839,225 | A | 6/1958 | Soffer et al. |
| 2,908,446 | A | 10/1959 | Strouse |
| 2,932,434 | A | 4/1960 | Abplanalp |
| 2,965,270 | A | 12/1960 | Soffer et al. |
| 2,968,441 | A | 1/1961 | Holcomb |
| 2,976,897 | A | 3/1961 | Beckworth |
| 2,997,243 | A | 8/1961 | Kolb |
| 3,083,872 | A | 4/1963 | Meshberg |
| 3,107,059 | A | 10/1963 | Frechette |
| 3,167,525 | A | 1/1965 | Thomas |
| 3,191,809 | A | 6/1965 | Schultz et al. |
| 3,196,819 | A | 7/1965 | Lechner et al. |
| 3,198,394 | A | 8/1965 | Lefer |
| 3,216,628 | A | 11/1965 | Fergusson |
| 3,246,850 | A | 4/1966 | Bourke |
| 3,258,208 | A | 6/1966 | Greenebaum, II |
| 3,284,007 | A | 11/1966 | Clapp |
| 3,314,571 | A | 4/1967 | Greenebaum, II |
| 3,317,140 | A | 5/1967 | Smith |
| 3,342,382 | A | 9/1967 | Huling |
| 3,346,195 | A | 10/1967 | Groth |
| 3,373,908 | A | 3/1968 | Crowell |
| 3,377,028 | A | 4/1968 | Bruggeman |
| 3,390,121 | A | 6/1968 | Burford et al. |
| 3,414,171 | A | 12/1968 | Grisham et al. |
| 3,415,425 | A | 12/1968 | Knight et al. |
| 3,425,600 | A | 2/1969 | Abplanalp |
| 3,428,224 | A | 2/1969 | Eberhardt et al. |
| 3,422,391 | A | 3/1969 | Krizka et al. |
| 3,450,314 | A | 6/1969 | Gross |
| 3,467,283 | A | 9/1969 | Kinnavy |
| 3,472,457 | A | 10/1969 | McAvoy |
| 3,482,738 | A | 12/1969 | Bartels |
| 3,514,042 | A | 5/1970 | Freed |
| 3,544,258 | A | 12/1970 | Presant et al. |
| 3,548,564 | A | 12/1970 | Bruce et al. |
| 3,575,319 | A | 4/1971 | Safianoff |
| 3,592,359 | A | 7/1971 | Marraffino |
| 3,596,835 | A | 8/1971 | Smith et al. |
| 3,608,822 | A | 9/1971 | Berthoud |
| 3,613,954 | A | 10/1971 | Bayne |
| 3,648,932 | A | 3/1972 | Ewald et al. |
| 3,653,558 | A | 4/1972 | Shay |
| 3,698,645 | A | 10/1972 | Coffey |
| 3,700,136 | A | 10/1972 | Ruekberg |
| 3,703,994 | A | 11/1972 | Nigro |
| 3,704,811 | A | 12/1972 | Harden, Jr. |
| 3,704,831 | A | 12/1972 | Clark |
| 3,764,067 | A | 10/1973 | Coffey et al. |
| 3,773,706 | A | 11/1973 | Dunn, Jr. |
| 3,776,470 | A | 12/1973 | Tsuchiya |
| 3,776,702 | A | 12/1973 | Chant |
| 3,777,981 | A | 12/1973 | Probst et al. |
| 3,788,521 | A | 1/1974 | Laauwe |
| 3,795,366 | A | 3/1974 | McGhie et al. |
| 3,799,398 | A | 3/1974 | Morane et al. |
| 3,806,005 | A | 4/1974 | Prussin et al. |
| 3,811,369 | A | 5/1974 | Ruegg |
| 3,813,011 | A | 5/1974 | Harrison et al. |
| 3,814,326 | A | 6/1974 | Bartlett |
| 3,819,119 | A | 6/1974 | Coffey et al. |
| 3,828,977 | A | 8/1974 | Borchert |
| 3,848,778 | A | 11/1974 | Meshberg |
| 3,862,705 | A | 1/1975 | Beres et al. |
| 3,871,553 | A | 3/1975 | Steinberg |
| 3,891,128 | A | 6/1975 | Smrt |
| 2,913,842 | A | 10/1975 | Singer |
| 3,912,132 | A | 10/1975 | Stevens |
| 3,913,803 | A | 10/1975 | Laauwe |
| 3,913,804 | A | 10/1975 | Laauwe |
| 3,932,973 | A | 1/1976 | Moore |
| 3,936,002 | A | 2/1976 | Geberth, Jr. |
| 3,938,708 | A | 2/1976 | Burger |
| 3,975,554 | A | 8/1976 | Kummins et al. |
| 3,982,698 | A | 9/1976 | Anderson |
| 3,989,165 | A | 11/1976 | Shaw et al. |
| 3,991,916 | A | 11/1976 | Del Bon |
| 3,992,003 | A | 11/1976 | Visceglia et al. |
| 4,010,134 | A | 3/1977 | Braunisch et al. |
| 4,032,064 | A | 6/1977 | Giggard |
| 4,036,673 | A | 7/1977 | Murphy et al. |
| 4,045,860 | A | 9/1977 | Winckler |
| 4,089,443 | A | 5/1978 | Zrinyi |
| 4,096,974 | A | 6/1978 | Haber et al. |
| 4,117,951 | A | 10/1978 | Winckler |
| 4,129,448 | A | 12/1978 | Greenfield et al. |
| 4,147,284 | A | 4/1979 | Mizzi |
| 4,148,416 | A | 4/1979 | Gunn-Smith |
| 4,154,378 | A | 5/1979 | Paoletti et al. |
| 4,164,492 | A | 8/1979 | Cooper |
| RE30,093 | E | 9/1979 | Burger |
| 4,171,757 | A | 10/1979 | Diamond |
| 4,185,758 | A | 1/1980 | Giggard |
| 4,187,959 | A | 2/1980 | Pelton |
| 4,187,985 | A | 2/1980 | Goth |
| 4,198,365 | A | 4/1980 | Pelton |
| 4,238,264 | A | 12/1980 | Pelton |
| 4,275,172 | A | 6/1981 | Barth et al. |
| 4,293,353 | A | 10/1981 | Pelton et al. |
| 4,308,973 | A | 1/1982 | Irland |
| 4,310,108 | A | 1/1982 | Motoyama et al. |
| 4,322,020 | A | 3/1982 | Stone |
| 4,346,743 | A | 8/1982 | Miller |
| 4,354,638 | A | 10/1982 | Weinstein |
| 4,358,388 | A | 11/1982 | Daniel et al. |
| 4,370,930 | A | 2/1983 | Strasser et al. |
| 4,372,475 | A | 2/1983 | Goforth et al. |
| 4,401,271 | A | 8/1983 | Hansen |
| 4,401,272 | A | 8/1983 | Merton et al. |
| 4,411,387 | A | 10/1983 | Stern et al. |
| 4,417,674 | A | 11/1983 | Giuffredi |
| 4,438,221 | A | 3/1984 | Fracalossi et al. |
| 4,442,959 | A | 4/1984 | Del Bon et al. |
| 4,460,719 | A | 7/1984 | Danville |
| 4,482,662 | A | 11/1984 | Rapaport et al. |
| 4,496,081 | A | 1/1985 | Farrey |
| 4,546,905 | A | 10/1985 | Nandagiri et al. |
| 4,609,608 | A | 9/1986 | Solc |
| 4,641,765 | A | 2/1987 | Diamond |
| 4,683,246 | A | 7/1987 | Davis et al. |
| 4,702,400 | A | 10/1987 | Corbett |
| 4,728,007 | A | 3/1988 | Samuelson et al. |
| 4,744,495 | A | 5/1988 | Warby |
| 4,761,312 | A | 8/1988 | Koshi et al. |
| 4,793,162 | A | 12/1988 | Emmons |
| 4,804,144 | A | 2/1989 | Denman |
| 4,815,414 | A | 3/1989 | Duffy et al. |
| 4,819,838 | A | 4/1989 | Hart, Jr. |
| 4,830,224 | A | 5/1989 | Brison |
| 4,839,393 | A | 6/1989 | Buchanan et al. |
| 4,854,482 | A | 8/1989 | Bergner |
| 4,870,805 | A | 10/1989 | Morane |
| 4,878,599 | A | 11/1989 | Greenway |
| 4,887,651 | A | 12/1989 | Santiago |
| 4,893,730 | A | 1/1990 | Bolduc |
| 4,896,832 | A | 1/1990 | Howlett |
| D307,649 | S | 5/1990 | Henry |
| 4,940,171 | A | 7/1990 | Gilroy |
| 4,949,871 | A | 8/1990 | Flanner |
| 4,953,759 | A | 9/1990 | Schmidt |
| 4,954,544 | A | 9/1990 | Chandaria |
| 4,955,545 | A | 9/1990 | Stern et al. |
| 4,961,537 | A | 10/1990 | Stern |
| 4,969,577 | A | 11/1990 | Werding |

(56) References Cited

U.S. PATENT DOCUMENTS 4,969,579 A 11/1990 Behar
4,988,017 A 1/1991 Schrader et al.
4,991,750 A 2/1991 Moral
5,007,556 A 4/1991 Lover
5,009,390 A 4/1991 McAuliffe, Jr. et al.
5,037,011 A 8/1991 Woods
5,038,964 A 8/1991 Bouix
5,052,585 A 10/1991 Bolduc
5,059,187 A 10/1991 Sperry et al.
5,065,900 A 11/1991 Scheindel
5,069,390 A 12/1991 Stern et al.
5,100,055 A 3/1992 Rokitenetz et al.
5,115,944 A 5/1992 Nikolich
5,126,086 A 6/1992 Stoffel
5,169,037 A 12/1992 Davies et al.
5,182,316 A 1/1993 DeVoe et al.
5,188,263 A 2/1993 Woods
5,188,295 A 2/1993 Stern et al.
5,211,317 A 5/1993 Diamond et al.
5,297,704 A 3/1994 Stollmeyer
5,307,964 A 5/1994 Toth
5,310,095 A 5/1994 Stern et al.
5,312,888 A 5/1994 Nafziger et al.
5,314,097 A 5/1994 Smrt et al.
5,323,963 A 6/1994 Ballu
5,341,970 A 8/1994 Woods
5,368,207 A 11/1994 Cruysberghs
5,374,434 A 12/1994 Clapp et al.
5,405,051 A 4/1995 Miskell
5,409,148 A 4/1995 Stern et al.
5,417,357 A 5/1995 Yquel
D358,989 S 6/1995 Woods
5,421,519 A 6/1995 Woods
5,425,824 A 6/1995 Marwick
5,450,983 A 9/1995 Stern et al.
5,467,902 A 11/1995 Yquel
5,476,879 A 12/1995 Woods et al.
5,489,048 A 2/1996 Stern et al.
5,498,282 A 3/1996 Miller et al.
5,501,375 A 3/1996 Nilson
5,505,344 A 4/1996 Woods
5,523,798 A 6/1996 Hagino et al.
5,524,798 A 6/1996 Stern et al.
5,544,783 A 8/1996 Conigliaro
5,548,010 A 8/1996 Franer
5,549,228 A 8/1996 Brown
5,558,247 A 9/1996 Caso
5,562,235 A 10/1996 Cruysberghs
5,570,813 A 11/1996 Clark, II
5,573,137 A 11/1996 Pauls
5,583,178 A 12/1996 Oxman et al.
5,597,095 A 1/1997 Ferrara, Jr.
5,639,026 A 6/1997 Woods
5,641,095 A 6/1997 de Laforcade
5,645,198 A 7/1997 Stern et al.
5,655,691 A 8/1997 Stern et al.
5,715,975 A 2/1998 Stern et al.
5,727,736 A 3/1998 Tryon
5,752,631 A 5/1998 Yabuno et al.
5,792,465 A 8/1998 Hagarty
5,799,879 A 9/1998 Ottl et al.
5,865,351 A 2/1999 De Laforcade
5,894,964 A 4/1999 Barnes et al.
5,915,598 A 6/1999 Yazawa et al.
5,921,446 A 7/1999 Stern
5,934,518 A 8/1999 Stern et al.
5,941,462 A 8/1999 Sandor
5,957,333 A 9/1999 Losenno et al.
5,975,356 A 11/1999 Yquel et al.
5,988,575 A 11/1999 Lesko
6,000,583 A 12/1999 Stern et al.
6,027,042 A 2/2000 Smith
6,032,830 A 3/2000 Brown
6,039,306 A 3/2000 Pericard et al.
6,070,770 A 6/2000 Tada et al.
6,092,698 A 7/2000 Bayer
6,095,435 A 8/2000 Greer, Jr. et al.
6,112,945 A 9/2000 Woods
6,113,070 A 9/2000 Holzboog
6,116,473 A 9/2000 Stern et al.
6,129,247 A 10/2000 Thomas et al.
6,131,777 A 10/2000 Warby
6,152,335 A 11/2000 Stern et al.
6,161,735 A 12/2000 Uchiyama et al.
6,168,093 B1 1/2001 Greer, Jr. et al.
6,170,717 B1 1/2001 Di Giovanni et al.
D438,111 S 2/2001 Woods
6,225,393 B1 5/2001 Woods
6,254,015 B1 7/2001 Abplanalp
6,257,503 B1 7/2001 Baudin
6,261,631 B1 7/2001 Lomasney et al.
6,265,459 B1 7/2001 Mahoney et al.
6,276,570 B1 8/2001 Stern et al.
6,283,171 B1 9/2001 Blake
6,290,104 B1 9/2001 Bougamont et al.
6,296,155 B1 10/2001 Smith
6,296,156 B1 10/2001 Lasserre et al.
6,299,679 B1 10/2001 Montoya
6,299,686 B1 10/2001 Mills
6,315,152 B1 11/2001 Kalisz
6,325,256 B1 12/2001 Liljeqvist et al.
6,328,185 B1 12/2001 Stern et al.
6,328,197 B1 * 12/2001 Gapihan ..... 228/144
6,352,184 B1 3/2002 Stern et al.
6,362,302 B1 3/2002 Boddie
6,375,036 B1 4/2002 Woods
6,382,474 B1 5/2002 Woods et al.
6,386,402 B1 5/2002 Woods
6,394,321 B1 5/2002 Bayer
6,394,364 B1 5/2002 Abplanalp
6,395,794 B2 5/2002 Lucas et al.
6,398,082 B2 6/2002 Clark et al.
6,399,687 B2 6/2002 Woods
6,415,964 B2 7/2002 Woods
6,439,430 B1 8/2002 Gilroy, Sr. et al.
6,446,842 B2 9/2002 Stern et al.
6,474,513 B2 11/2002 Burt
6,478,198 B2 11/2002 Haroian
6,478,561 B2 11/2002 Braun et al.
6,482,392 B1 11/2002 Zhou et al.
D468,980 S 1/2003 Woods
6,510,969 B2 1/2003 Di Giovanni et al.
6,531,528 B1 3/2003 Kurp
6,536,633 B2 3/2003 Stern et al.
6,581,807 B1 6/2003 Mekata
6,588,628 B2 7/2003 Abplanalp et al.
6,595,393 B1 7/2003 Loghman-Adham et al.
6,615,827 B2 9/2003 Greenwood et al.
6,637,627 B1 10/2003 Liljeqvist et al.
6,641,005 B1 11/2003 Stern et al.
6,641,864 B2 11/2003 Woods
6,652,704 B2 11/2003 Green
6,659,312 B1 12/2003 Stern et al.
6,666,352 B1 * 12/2003 Woods ..... 222/1
6,688,492 B2 2/2004 Jaworski et al.
6,712,238 B1 3/2004 Mills
6,726,066 B2 4/2004 Woods
6,736,288 B1 5/2004 Green
6,758,373 B2 7/2004 Jackson et al.
6,797,051 B2 * 9/2004 Woods ..... 106/802
6,802,461 B2 10/2004 Schneider
6,832,704 B2 12/2004 Smith
6,837,396 B2 1/2005 Jaworski et al.
6,843,392 B1 1/2005 Walker
6,848,601 B2 2/2005 Greer, Jr.
6,851,575 B2 2/2005 van't Hoff
6,880,733 B2 4/2005 Park
6,883,688 B1 4/2005 Stern et al.
6,905,050 B1 6/2005 Stern et al.
6,910,608 B2 6/2005 Greer, Jr. et al.
6,913,407 B2 7/2005 Greer et al.
6,926,178 B1 8/2005 Anderson
6,932,244 B2 8/2005 Meshberg
6,966,467 B2 11/2005 Di Giovanni et al.

(56) References Cited

U.S. PATENT DOCUMENTS

| | | | | |
|---|---|---|---|---|
| 6,971,553 | B2 | 12/2005 | Brennan et al. | |
| 6,978,916 | B2 | 12/2005 | Smith | |
| 6,978,947 | B2 | 12/2005 | Jin | |
| 6,981,616 | B2 | 1/2006 | Loghman-Adham et al. | |
| 7,014,073 | B1 * | 3/2006 | Stern et al. | 222/402.1 |
| 7,014,127 | B2 | 3/2006 | Valpey, III et al. | |
| 7,036,685 | B1 | 5/2006 | Green | |
| 7,059,497 | B2 | 6/2006 | Woods | |
| 7,059,546 | B2 | 6/2006 | Ogata et al. | |
| 7,063,236 | B2 | 6/2006 | Greer, Jr. et al. | |
| 7,104,424 | B2 | 9/2006 | Kolanus | |
| 7,104,427 | B2 | 9/2006 | Pericard et al. | |
| 7,121,434 | B1 | 10/2006 | Caruso | |
| 7,163,962 | B2 | 1/2007 | Woods | |
| 7,182,227 | B2 | 2/2007 | Poile et al. | |
| 7,189,022 | B1 | 3/2007 | Greer, Jr. et al. | |
| 7,192,985 | B2 | 3/2007 | Woods | |
| 7,556,841 | B2 | 7/2009 | Kimball et al. | |
| 2001/0002676 | A1 | 6/2001 | Woods | |
| 2002/0003147 | A1 | 1/2002 | Corba | |
| 2002/0100769 | A1 | 8/2002 | McKune | |
| 2002/0119256 | A1 | 8/2002 | Woods | |
| 2003/0102328 | A1 | 6/2003 | Abplanalp et al. | |
| 2003/0134973 | A1 | 7/2003 | Chen et al. | |
| 2003/0183651 | A1 | 10/2003 | Greer, Jr. | |
| 2003/0205580 | A1 | 11/2003 | Yahav | |
| 2004/0012622 | A1 | 1/2004 | Russo et al. | |
| 2004/0099697 | A1 | 5/2004 | Woods | |
| 2004/0141797 | A1 | 7/2004 | Garabedian et al. | |
| 2004/0157960 | A1 | 8/2004 | Rowe | |
| 2004/0195277 | A1 | 10/2004 | Woods | |
| 2005/0121474 | A1 | 6/2005 | Lasserre et al. | |
| 2005/0161531 | A1 * | 7/2005 | Greer et al. | 239/337 |
| 2005/0236436 | A1 | 10/2005 | Woods | |
| 2005/0256257 | A1 | 11/2005 | Betremieux et al. | |
| 2006/0049205 | A1 | 3/2006 | Green | |
| 2006/0079588 | A1 | 4/2006 | Greer, Jr. | |
| 2006/0180616 | A1 | 8/2006 | Woods | |
| 2006/0219808 | A1 | 10/2006 | Woods | |
| 2006/0219811 | A1 | 10/2006 | Woods | |
| 2006/0273207 | A1 | 12/2006 | Woods | |
| 2007/0178243 | A1 | 8/2007 | Houck et al. | |
| 2007/0260011 | A1 | 11/2007 | Woods | |
| 2007/0272768 | A1 | 11/2007 | Williams et al. | |

FOREIGN PATENT DOCUMENTS

| | | |
|---|---|---|
| CA | 2381994 | 2/2001 |
| CA | 2065534 | 8/2003 |
| CA | 2504509 | 10/2005 |
| CA | 2504513 | 10/2005 |
| CH | 680849 | 11/1992 |
| DE | 210449 | 5/1909 |
| DE | 1926796 | 3/1970 |
| DE | 3808438 | 4/1989 |
| DE | 3806991 | 9/1989 |
| FR | 463476 | 2/1914 |
| FR | 84727 | 9/1965 |
| FR | 1586067 | 2/1970 |
| FR | 2659847 | 9/1991 |
| GB | 867713 | 5/1961 |
| GB | 977860 | 12/1964 |
| GB | 1144385 | 3/1969 |
| JP | 461392 | 1/1971 |
| JP | 8332414 | 12/1996 |
| WO | 9418094 | 8/1994 |

OTHER PUBLICATIONS

Newman-Green, Inc., "Aerosol Valves, Sprayheads & Accessories Catalog", Apr. 1, 1992, pp. 14, 20, and 22.

Chadwick, "Aerosol Technical Solutions", Jul./Aug. 2004, 3 pages, vol. 102, No. 7/8.

* cited by examiner

PIGMENTED SPRAY TEXTURE MATERIAL COMPOSITIONS, SYSTEMS, AND METHODS

RELATED APPLICATIONS

This application, U.S. patent application Ser. No. 13/312,893 filed Dec. 6, 2011, is a continuation of U.S. patent application Ser. No. 12/080,638 filed Apr. 3, 2008, now abandoned.

U.S. patent application Ser. No. 12/080,638 claims benefit of U.S. Provisional Patent Application Ser. No. 60/922,119 filed Apr. 5, 2007.

The contents of all related applications listed above are incorporated herein by reference.

TECHNICAL FIELD

The present invention relates to coating materials and, more particularly, to coating materials adapted to provide a desirable aesthetic look to a surface.

BACKGROUND

The surfaces of drywall materials defining wall and ceiling surfaces are commonly coated with texture materials. Texture materials are coatings that are deposited in discrete drops that dry to form a bumpy, irregular texture on the destination surface. Texture materials are commonly applied using a hopper gun connected to a source of pressurized air. However, when only a small area is to be coated or an existing textured surface is repaired, texture materials are typically applied using an aerosol dispensing system.

An aerosol dispensing system for dispensing texture material typically comprises a container assembly, a valve assembly, and an outlet assembly. The container assembly contains the texture material and a propellant material. The propellant material pressurizes the texture material within the container assembly. The valve assembly is mounted to the container assembly in a normally closed configuration but can be placed in an open configuration to define a dispensing path along which the pressurized texture material is forced out of the container assembly by the propellant material. Displacement of the outlet assembly places the valve assembly in the open configuration. The outlet assembly defines a portion of the outlet path and is configured such that the texture material is applied to the destination surface in an applied texture pattern.

The texture material dispensed by an aerosol dispensing system may employ a solvent base, a water base, or a base containing a combination of water and water soluble solvents. A solvent based texture material dries quickly but can be malodorous and may require the use of complementary solvent cleaners for clean up. A water based texture material is typically not malodorous and can be cleaned using water but can take significantly longer to dry. A water/solvent based texture material can be cleaned using water, is typically not unacceptably malodorous, and has a dry time somewhere between solvent based and water based texture materials.

The propellant used by aerosol dispensing systems for texture materials may simply be a compressed inert gas such as air or nitrogen. More typically, the propellant used by aerosol dispensing systems is a bi-phase propellant material, including mixtures of volatile hydrocarbons such as propane, n-butane, isobutane, dimethyl ether (DME), and methylethyl ether.

At room temperature, bi-phase propellant materials typically exist in both liquid and vapor states within the container assembly. Prior to use, the vapor portion of the bi-phase propellant material is pressurized to an equilibrium pressure. When the valve assembly is placed in its open configuration, the vapor portion of the bi-phase propellant material forces the texture material out of the container assembly along the dispensing path.

When the valve assembly returns to its closed position, part of the liquid portion of the bi-phase propellant material changes to the vapor state because of the drop in pressure within the container assembly. The vapor portion of the propellant material returns the pressure within the container assembly to the equilibrium value in preparation for the next time texture material is to be dispensed from the aerosol dispensing system.

The container assembly typically comprises a metal tube structure formed by a rectangular metal sheet that is rolled and joined at two overlapping edges to form a seam. A bottom cap and end cap are welded or crimped onto the tube structure. The valve assembly and the outlet assembly are typically supported by the end cap.

Aerosol container assemblies are typically made of either tin-plated steel or aluminum. Aluminum container assemblies are typically used for water based or water/solvent based texture materials because the water in the formulation promotes corrosion and aluminum is less susceptible to corrosion. However, the costs and availability of aluminum and tin-plated steel aerosol container assemblies may differ.

To finish a wall using texture materials, a primer coat of primer is typically applied to the bare surface of a wall structure. The purpose of the primer coat is to form a layer that bonds firmly to the bare wall surface and to which any subsequent layer of coating material securely bonds. The primer coat is typically pigmented in a neutral cover that can easily be hidden by any subsequent layer of coating material.

If a texture pattern is desired, a coat of texture material is then applied to the primer coat. As described above, the texture material is formulated to form a texture coat in a desired three-dimensional texture pattern that is aesthetically pleasing and which also helps hides imperfections and structural components of the wall structure. The texture material is primarily formulated to be deposited onto the primer coat in the desired texture pattern and such that the texture coat dries in the desired texture pattern. The texture coat formed by conventional texture material is not durable; the texture coat may easily be removed, intentionally or inadvertently.

Accordingly, a finish coat of paint material is typically applied over the texture coat. The finish coat is thin, even, and highly durable and is also pigmented for aesthetic purposes. The thin finish coat follows the contours of the texture pattern formed by the texture coat, so the finished surface is both textured and pigmented.

Once the base layer is formed, the process of forming a durable, pigmented, textured finished surface thus requires the application of at least two separate coats: a texture coat and a finish coat.

The need exists for formulations of either water based or water/solvent based texture materials that may be used to form a texture pattern that is both pigmented and durable in a single coat.

SUMMARY

The present invention may be embodied as a coating material adapted to be applied to a target surface comprises a texture material base and pigment material. The texture material base comprises solvent/carrier material comprising water, resin/binder material comprising a latex binder, and filler material comprising a polymeric thickener. The texture material base and the pigment material are combined and deposited on the target surface to form a durable, irregular, colored surface.

The present invention may also be embodied as a system for applying a coating material to a target surface, comprising a container assembly, a valve assembly, an outlet assembly, a texture material base, pigment material, and propellant material. The container assembly and the valve assembly define a main chamber. The texture material base comprises solvent/carrier material, resin/binder material, and filler material. The texture material base and the pigment material are combined to form a pigmented texture material. The pigmented texture material and the propellant material are combined within the main chamber. Operation of the valve assembly allows the propellant material to force the pigmented texture material out of the main chamber through the outlet assembly. The outlet assembly is arranged such that the pigmented texture material is deposited on the target surface to form a durable, irregular, colored surface.

The present invention may also be embodied as a method of applying a coating material to a target surface comprising the following steps. A texture material base comprising solvent/carrier material, resin/binder material, and filler material is mixed with pigment material to obtain a pigmented texture material. The pigmented texture material and propellant material are combined within a main chamber defined by a container assembly and a valve assembly. The valve assembly is operated to allow the propellant material to force the pigmented texture material out of the main chamber such that the pigmented texture material is deposited on the target surface to form a durable, irregular, colored surface.

The present invention may also be embodied as a method of forming a coating on a target surface comprising the following steps. A paint material associated with a first color is provided. The paint material is applied to the target surface to form a paint coat. A texture material base comprising solvent/carrier material, resin/binder material, and filler material is mixed with pigment material to obtain a pigmented texture material associated with a second color. The pigmented texture material and the propellant material are combined within a main chamber defined by a container assembly and a valve assembly. The valve assembly is operated to allow the propellant material to force the pigmented texture material out of the main chamber such that the pigmented texture material is deposited on the paint coat to form a durable, irregular texture coating in an applied texture pattern on top of the paint coat.

DETAILED DESCRIPTION

Figure 1:
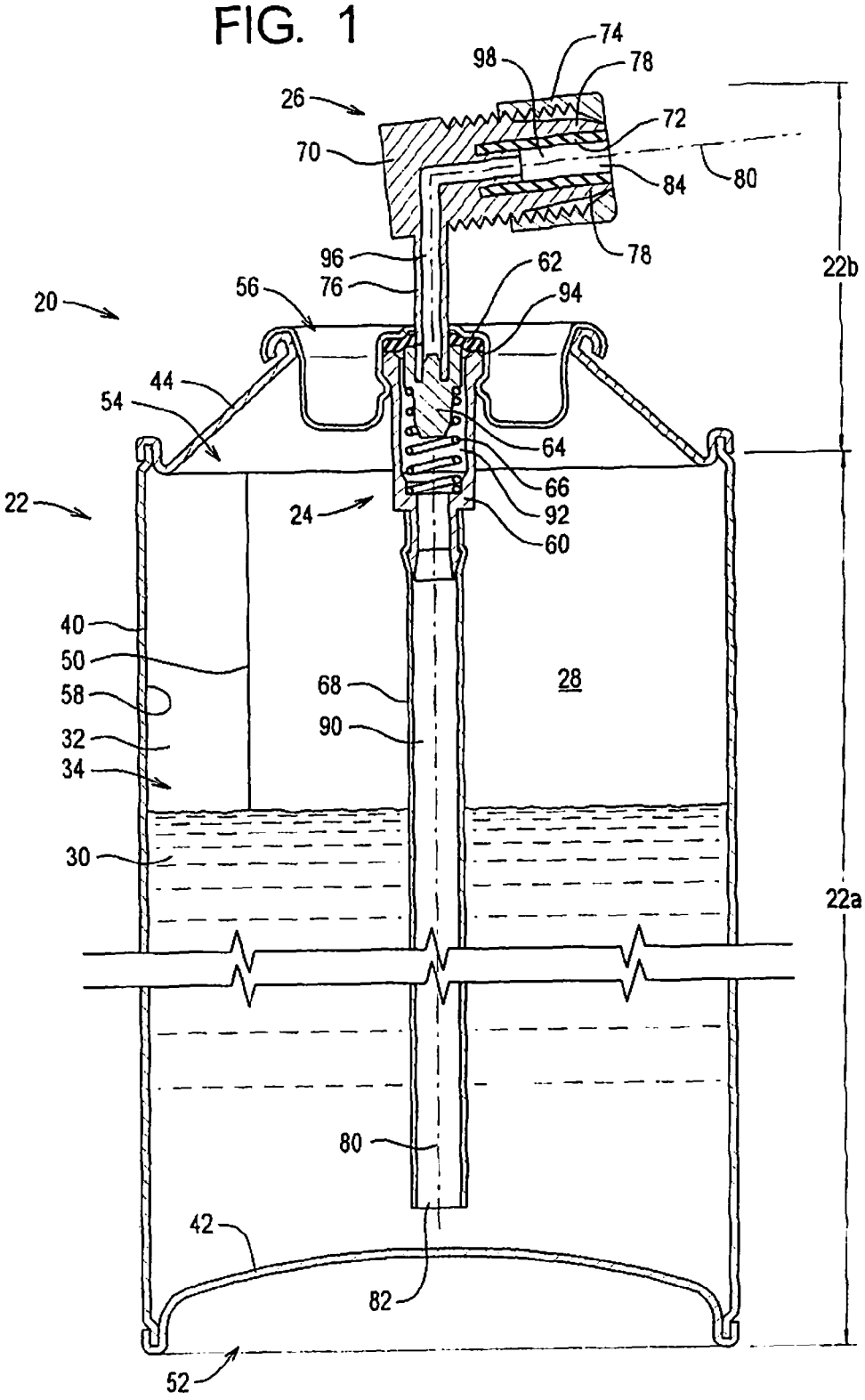
FIG. 1 is a side elevation, cross-sectional view depicting a first example aerosol dispensing system dispensing pigmented texture material of the present invention onto a target surface.

Referring initially to FIG. 1 of the drawing, depicted therein is an aerosol dispensing system 20 constructed in accordance with, and embodying, the principles of the present invention. The aerosol dispensing system 20 comprises a container assembly 22, a valve assembly 24, and an outlet assembly 26. The container assembly 22 and valve assembly 24 define a main chamber 28.

The main chamber 28 contains a liquid material 30 and a vapor material 32. The liquid material 30 comprises propellant material in liquid form and a pigmented texture material. The vapor material 32 comprises propellant material in vapor form. The combination of the liquid material 30 and the vapor material 32 in the container assembly 22 will be referred to as the contained material 34.

When the valve assembly 24 is in a closed configuration, the flow of fluid out of the main chamber 28 is substantially prevented. However, the vapor material 32 pressurizes the liquid material 30 within the main chamber 28 such that, when the valve assembly 24 is in an open configuration, the vapor material 32 forces the liquid material 30 out of the main chamber 28.

As perhaps best shown in FIG. 1, the example container assembly 22 comprises a main member 40, a bottom cap 42, and an end cap 44 formed of tin-plated steel. The tin-plated steel used to form the main member 40, bottom cap 42, and end cap 44 comprises a thin sheet of steel coated on one side by an even thinner layer (approximately 0.5 microns) of tin.

The main member 40 is a rectangular sheet that is rolled into a cylinder and welded along a seam 50 to define first and second end openings 52 and 54. The bottom cap 42 is a shaped tin-plated steel member that is crimped onto the cylindrical main member 40 to seal the first end opening 52. The end cap 44 is also a shaped tin-plated steel member defining a mounting opening 56; the end cap 44 is crimped onto the main member 40 such that fluid may not flow through the second opening 54 between the end cap 44 and the main member 40. The main member 40, bottom cap 42, and end cap 44 define an interior metal surface 58 of the container assembly 22.

With the bottom cap 42 covering the first opening 52, the end cap 44 covering the second opening 54, and the valve assembly 24 supported by the end cap 44, the aerosol dispensing system 20 defines the main chamber 28.

Alternatively, the container assembly 22 may be made of aluminum, in which case the bottom cap portion and the end cap portion may be integrally formed with the main member portion.

The example texture material base is generally formulated as follows.

EXAMPLE OF PIGMENTED TEXTURE MATERIAL

| COMPONENT | FIRST EXAMPLE | FIRST PREFERRED RANGE | SECOND PREFERRED RANGE |
|---|---|---|---|
| solvent/carrier | 21.4% | 16-31% | 10-40% |
| resin/binder | 36.2% | 31-41% | 26-46% |
| fillers | 41.8% | 36-46% | 31-51% |
| additives | 0.6% | 0.2-1.0% | 0.0-3% |

The solvent/carrier of the example formulation set forth in the table above is water, but the solvent/carrier may be formed by water in combination with water soluble solvents. The resin/binder is or may be a conventional latex binder containing 55% solids.

The fillers may comprise any conventional pigments, extenders, and thickeners. The example formulation set forth in the table above uses a polymeric thickener such as Acusol 820 or its equivalent. The polymeric thickener provides desirable viscosity characteristics that allow the pigmented texture material to be dispensed using an aerosol structure but still form desired three-dimensional texture patterns as will be described elsewhere herein. The example formulation comprises approximately 3.3% by weight of the polymeric thickener. The polymeric thickener should be within a first preferred range of substantially between 2% and 5% and in any event should be within a second preferred range of substantially between 1% and 10%.

If used, the additives forming part of the formulation described in the table set forth above typically comprise conventional biocides, dispersants, and defoamers.

To the texture material base described above is added a color pigment or combination of color pigments such that the texture material base is a desired color. The color pigment material or materials may be conventional, and conventional systems for determining appropriate amounts of one or more individual color pigment materials may be used or modified to determine the amounts of individual color pigment materials necessary to obtain the desired final color to the texture material base.

The addition of one or more color pigments to a paint material base is common practice in the paint industry. At the factory level, pigments are added to the paint material base to obtain prepackaged, colored paints. The customer thus may select from the limited number of colors provided by the manufacturer. In addition, pigments are added to containers of paint material base at the retail level to allow consumers to select from virtually an unlimited number of colors.

The texture material base described above may also be pigmented at the factory or at the retail level. Currently, retailers typically have the facilities to add texture material to non-pressurized containers of paint base, but do not typically have the facilities to add pigment to aerosol containers of paint base. Accordingly, while it is possible that the color pigment can be added to the texture material base at the retail level, the color pigment will more likely be added to the texture material base at the factory level when the pigmented texture material is sold in an aerosol form as described herein.

The exact amount of color pigment added to the texture material base will be determined based on the particular color desired. Typically, color pigment is added to the texture material base described in the table above in a first acceptable range of between approximately 0.5% and 1.0% by weight; however, the color pigment may be added to the texture material base described in the table above in a second acceptable range of between approximately 0.0% and 5.0% by weight.

The texture material base described in the table set forth above, along with any color pigment included therein, is combined in the container assembly 22 with the propellant material to obtain the contained material 34. The preferred amount of propellant material used to form the example dispensing system 20 is approximately 15.4% of the texture material base by weight and is preferably within a first preferred range of substantially between 12% and 18%% and is in any event preferably within a second preferred range of substantially between 8% and 22%. The propellant material is typically dimethyl ether (DME).

In the context of the example container assembly 22 comprising tin-plated steel components, the texture material base may be formulated to have anti-corrosion properties. In this case, the texture material base may further comprise first and second anti-corrosion materials are included to promote passive corrosion behavior of the metal interior surface 58 of the container assembly 22 in contact with the texture material base. Passive corrosion behavior occurs when the interaction between a metal structure and the environment forms a thin protective film on the surface of the metal structure. Passive corrosion produces essentially no corrosion of the metal structure and thus is very desirable.

In the example texture material base, the first anti-corrosion material is Elfugin, which is an anionic, phosphate ester. Elfugin is a proprietary product sold by Clariant Paper Chemicals as an antistatic for application to paper products. In the general example described above, approximately 1.00% (±5%) of the first anti-corrosion material is preferably used. The second anti-corrosion material of the example texture material base is sodium nitrite. In the general example described above, approximately 0.100% (±5%) or 0.250% (±5%) of the first anti-corrosion material is preferably used, depending upon the nature of the remaining components of the texture material base and propellant.

Generally speaking, the first anti-corrosion material should be within a first preferred range of substantially between 0.5% and 2% and in any event should be within a second preferred range of substantially between 0.1 and 5.0%. The second anti-corrosion material should be within a first preferred range of substantially between 0.05% and 1.0% and in any event should be within a second preferred range of substantially between 0.025% and 2.0%. The amount of water set forth in the foregoing table should be reduced by the amount of the first and second anti-corrosion materials used.

If the anti-corrosion materials are used, the texture material base is preferably formulated and combined with propellant material as follows. The first and second anti-corrosion materials are initially dissolved in the water. The remaining materials are then mixed with the water solution to obtain the texture material base.

If the container assembly 22 is formed of tin-plated steel, the bottom cap 42 is crimped onto the main member 40 to form a container subassembly 22*a*. The valve assembly 24 is combined with the end cap 44 to form a cap subassembly 22*b*. The texture material base is placed within the container subassembly 22*a*. The cap subassembly 22*b* is crimped onto the container subassembly 22*a* to form the container assembly 22. The propellant material is then introduced into the container assembly 22 through the valve assembly 24. The outlet assembly 26 is then engaged with the valve assembly to form the aerosol dispensing system 20.

With the foregoing general understanding of the present invention, the details of several example formulations of the texture material base and the construction and use of the example aerosol dispensing system 20 will now be described in further detail with reference to FIG. 1.

The example valve assembly 24 comprises a valve housing 60, a valve seat 62, a valve member 64, and a valve spring 66. The end cap 44 supports the valve housing 60 and the valve seat 62 adjacent to the mounting opening 56. The valve housing 60 supports the valve spring 66 such that the valve spring 66 biases the valve member 64 against the valve seat 62 in a normally closed position. An intake tube 68 extends from the valve housing 60 to the end of the main member 40 closed by the bottom cap 42.

The outlet assembly 26 comprises an actuator member 70, a resilient member 72, and a clamp member 74. The actuator member 70 defines a stem to portion 76 and a plurality of finger portions 78. The stem portion 76 extends through the mounting opening 56 and engages the valve member 64. The actuator member 70 supports the resilient member 72 such that the resilient member 72 is held within the finger portions 78. The clamp member 74 engages the actuator member 70 such that displacement of the clamp member 74 relative to the actuator member 70 bends the finger portions 78 towards each other to deform the resilient member 72.

A dispensing path 80 extends between an inlet opening 82 defined by the intake tube 68 and an outlet opening 84 defined by the resilient member 72. Fluid is prevented from flowing along the dispensing path 80 when the valve assembly 24 is in the closed configuration as defined above. Fluid may flow along the dispensing path 80 when the valve assembly 24 is in the open configuration. The spray pattern of liquid flowing out of the main chamber 28 through the outlet opening 84 may be varied by deforming the resilient member 72 as described above.

More specifically, the valve spring 66 normally biases the valve member 64 against the valve seat 62 to close the dispensing path 80. When the actuator member 70 is displaced towards the container assembly 22, the valve member 64 is displaced away from the valve seat 62 against the force of the valve spring 66 to place the valve assembly 24 in its open configuration. In this open configuration, the example dispensing path 80 extends through a first passageway 90 defined by the intake tube 68, a valve chamber 92 defined by the valve housing 60, a gap 94 between valve member 64 and the valve seat 62, a second passageway 96 defined by the actuator member 70, and a third passageway 98 defined by the resilient member 72.

Figure 2A:
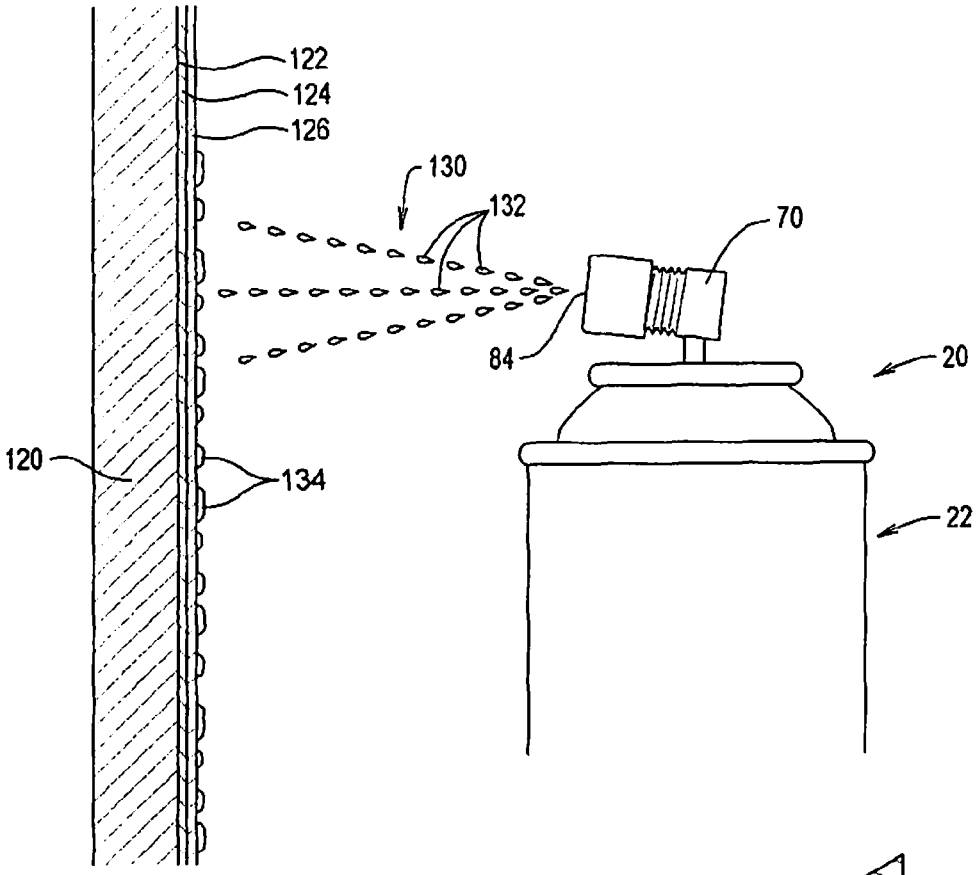
FIG. 2A is a side elevation view depicting the process of using the example aerosol dispensing system of FIG. 1 to apply pigmented texture material to form a pigmented texture pattern on a first example destination wall surface.
Figure 2B:
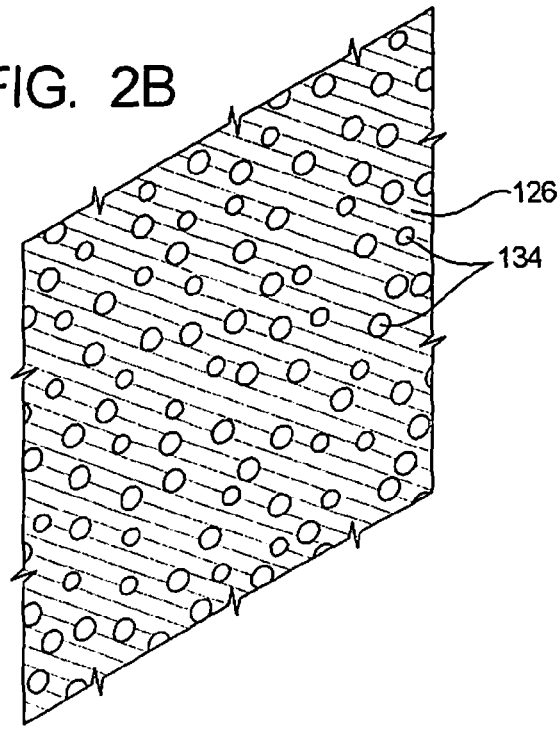
FIG. 2B is a perspective view of the pigmented texture pattern on the destination wall surface shown in FIG. 2A.

Turning now to FIGS. 2A-2B of the drawing, depicted therein is an example of use of the example dispensing system 20 described above. The example dispensing system 20 is used to apply texture material to a wall member 120 defining a target surface 122. Formed on the target surface 122 is a primer coat 124 and a paint coat 126. In this example, the finished surface is what is referred to as a smooth coat, and no texture material has been applied between the primer coat 124 and the paint coat 126.

Initially, the dispensing system 20 is arranged such that the outlet opening 84 faces the target surface 122. The actuator member 70 is then displaced to place the valve assembly 24 in its open configuration. The pressurized propellant material causes a portion of the contained material 34 to be dispensed from the container assembly 22 through the dispensing path 80.

Because of the formulation of the contained material 34 and the geometry of the resilient member 72, the contained material exits the container assembly 22 in a spray 130 comprising discrete droplets 132. The droplets 132 are deposited onto the target surface 122 to form a texture coating 134 in an applied texture pattern. The texture coating 134 is initially wet but dries when exposed to air.

By appropriately selecting the cross-sectional area of the outlet opening 84, the applied texture pattern of the texture coating 134 can be formed such that the pigmented texture material is applied in a desired texture pattern. As shown by FIG. 2A, the desired texture pattern formed by the texture coating 134 extends away from the surface of the paint coat 126. As shown by FIG. 2B, the example desired texture pattern formed by the texture coating 134 is of a different color (shown as white) from the color (shown by cross-hatching) of the paint coat 126.

It may be possible to pigment the pigmented texture material such that the texture coating 134 is the same color as the paint coat 126. In this case, the color of the texture coating 134 will be the same or almost the same as that of the paint coat 126, but the texture coating 134 will still extend away from the paint coat 126.

Figure 3:
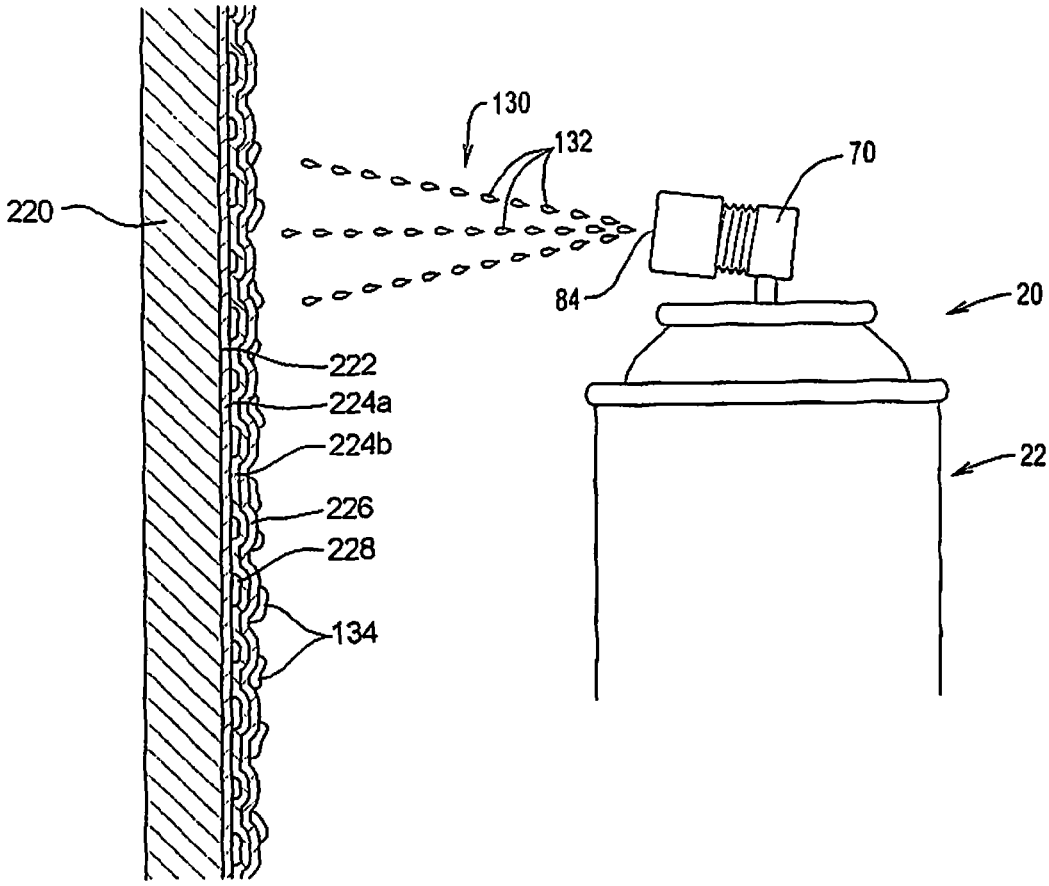
FIG. 3 is a side elevation view depicting the process of using the example aerosol dispensing system of FIG. 1 to apply pigmented texture material to form a pigmented texture pattern on a second example destination wall surface.

Turning now to FIG. 3 of the drawing, depicted therein is a second example of use of the example dispensing system 20 described above. The example dispensing system 20 is used to apply texture material to a wall member 220 defining a target surface 222. Formed on the target surface 222 are a first primer coat 224*a* and a paint coat 226. In this example, the finished surface is textured, and a conventional coat 228 of texture material has been applied between the primer coat 224*a* and the paint coat 226.

Ideally, a second primer coat 224 is formed after the texture coat 228 has is been formed; the example texture coat 228 is thus between the first and second primer coats 224*a* and 224*b*, and the paint coat 226 is formed on the second primer coat 224*b*. It should be recognized that the principles of the present invention may be implemented without one or more of the primer coats 224*a* and 224*b*, but the appearance and function of the resulting finish surface may not be as desired.

Initially, the dispensing system 20 is arranged such that the outlet opening 84 faces the target surface 222. The actuator member 70 is then displaced to place the valve assembly 24 in its open configuration. The pressurized propellant material causes a portion of the contained material 34 to be dispensed from the container assembly 22 through the dispensing path 80.

Because of the formulation of the contained material 34 and the geometry of the resilient member 72, the contained material exits the container assembly 22 in a spray 130 comprising discrete droplets 132. The droplets 132 are deposited onto the target surface 222 to form a texture coating 134 in an applied texture pattern. The texture coating 134 is initially wet but dries when exposed to air.

By appropriately selecting the cross-sectional area of the outlet opening 84, the applied texture pattern of the texture coating 134 can be formed such that the pigmented texture material is applied in a desired texture pattern. As shown by FIG. 3, the desired texture pattern formed by the texture coating 134 extends away from the surface of the paint coat 226. Typically, the example desired texture pattern formed by the texture coating 134 is of a different color from the color of the paint coat 226. The color of the texture coating 134 thus contrasts with that of the paint coat 226.

In the example dispensing system 20 described above, the outlet opening 84 is varied using the collar 74 to deform the fingers 78 and thus the resilient member 72. Alternatively, the outlet opening of the dispensing system 20 may be varied using any of the structures described, for example, in U.S. Pat. No. 6,536,633, and the teachings of that patent are incorporated herein by reference.

The scope of the present invention should be determined by the claims appended hereto and not the foregoing description of details of examples of the invention.

What is claimed is:

1. A method of applying a coating material to a target surface defined by a wall, comprising the steps of:

providing a pigmented texture material comprising 10-40% by weight of carrier material, 26-46% by weight of binder material, and 31-51% by weight of filler material comprising pigment material;

combining the pigmented texture material and a propellant material within a main chamber defined by a container assembly and a valve assembly; and operating the valve assembly to allow the propellant material to force the pigmented texture material out of the main chamber such that the pigmented texture material is deposited on the target surface in discrete droplets, where the binder material, filler material, and pigment material are combined such that the discrete droplets define a physical structure that is visibly distinct from the target surface, define a texture color associated with a color of the pigment material, and are sufficiently durable to function as part of a final wall surface.

2. A method as recited in claim 1, in which the step of providing the texture material base further comprises the step of adding at least one of biocides, dispersants, and defoamers.

3. A method as recited in claim 1, in which:

the step of providing the container assembly comprises the step of forming at least a portion of the container assembly of tin-plated steel; and the step of providing the texture material base further comprises the step of adding at least one anti-corrosion material.

4. A method as recited in claim 1, in which:

the step of providing the container assembly comprises the step of forming at least a portion of the container assembly of tin-plated steel; and the step of providing the texture material base further comprises the step of adding first and second anti-corrosion materials to the texture material base to form a thin protective film on surfaces formed by the tin-plated steel of the container assembly.

5. A method of forming a final wall surface defined by a wall, comprising the steps of:

providing a paint material, where the paint material is associated with a first color;

applying the paint material to a target surface defined by the wall to form a paint coat;

providing a pigmented texture material base comprising 10-40% by weight of carrier material, 26-46 by weight of binder material, and 31-51% by weight of filler material comprising pigment material, where the pigmented texture material is associated with a second color;

combining the pigmented texture material and a propellant material within a main chamber defined by a container assembly and a valve assembly; and operating the valve assembly to allow the propellant material to force the pigmented texture material out of the main chamber such that the pigmented texture material is deposited on the paint coat in discrete droplets to form an applied texture pattern on top of the paint coat, where the binder material, filler material, and pigment material are combined such that the discrete droplets define a physical structure that is visibly distinct from the target surface, define a texture color associated with a second color that is visibly distinct from the first color, and are sufficiently durable to function as part of the final wall surface.

6. A method as recited in claim 5, further, comprising the steps of:

providing a primer material;

applying the primer material to the target surface to form a primer coat, where the paint coat is formed on top of the primer coat.

* * * * *